US005364484A

United States Patent [19]

Redmond

[11] Patent Number: 5,364,484

[45] Date of Patent: Nov. 15, 1994

[54] METHOD AND APPARATUS FOR COLLATING AUTOMATICALLY PRODUCED PACKAGES OR OTHER PRODUCTION UNITS

[75] Inventor: Sanford Redmond, Stamford, Conn.

[73] Assignee: Sanford Redmond inc., Bronx, N.Y.

[21] Appl. No.: 947,944

[22] Filed: Sep. 21, 1992

Related U.S. Application Data

[63] Continuation of Ser. No. 810,562, Dec. 20, 1991, abandoned, which is a continuation of Ser. No. 421,257, Oct. 13, 1989, abandoned.

[51] Int. Cl.[5] ..... B32B 31/00

[52] U.S. Cl. ..... 156/250; 156/510; 156/552; 53/453; 53/559

[58] Field of Search ..... 156/250, 510, 552, 522; 53/452, 453, 397, 141, 534, 251, 559; 100/151, 154; 83/660, 868; 198/469.1, 688.1, 803.14, 803.15, 816; 221/73, 210; 271/33

[56] References Cited

U.S. PATENT DOCUMENTS

| | | | |
|---|---|---|---|
| 2,813,033 | 11/1957 | Schneider | 426/392 |
| 3,256,784 | 6/1966 | Booth | 493/74 |
| 3,544,411 | 12/1970 | Staats | 156/353 |
| 3,631,652 | 1/1972 | Redmond et al. | 53/124 D |
| 3,986,640 | 10/1976 | Redmond | 222/92 |
| 4,196,035 | 4/1980 | Reil | 156/361 |
| 4,493,574 | 1/1985 | Redmond et al. | 401/132 |
| 4,607,761 | 8/1986 | Wright et al. | 221/25 |
| 4,611,715 | 9/1986 | Redmond | 206/484 |
| 4,615,758 | 10/1986 | Held | 156/359 |
| 4,619,195 | 10/1986 | Held | 100/154 |
| 4,700,532 | 10/1987 | Redmond | 53/452 |
| 4,720,014 | 1/1988 | Redmond | 206/525 |
| 4,724,982 | 2/1988 | Redmond | 222/94 |
| 4,819,406 | 4/1989 | Redmond | 53/51 |
| 4,894,106 | 1/1990 | Instance | 156/227 |

FOREIGN PATENT DOCUMENTS

| | | |
|---|---|---|
| 1039444 | 3/1954 | Germany . |
| 1208745 | 10/1970 | United Kingdom . |

*Primary Examiner*—David A. Simmons
*Assistant Examiner*—J. Sells
*Attorney, Agent, or Firm*—Morgan & Finnegan

[57] ABSTRACT

A collator and collating method employs a continuous or intermittently driven thin web member for collating a plurality of articles supplied from an automatic production machine or the like. The web is preferably coated on one side with an adhesive which removably adheres to the articles being collated, permitting the articles to be secured in any desired collated pattern during handling and shipping while allowing easy removal after shipment. The web may be cut into desired lengths with the collated articles adhered thereto for stacking one on top of another during shipment or storage. In alternate embodiments, openings or pockets are formed in the web, which may or may not also be adhesively coated, for locating the collated articles in desired patterns.

7 Claims, 5 Drawing Sheets

METHOD AND APPARATUS FOR COLLATING AUTOMATICALLY PRODUCED PACKAGES OR OTHER PRODUCTION UNITS

This is a continuation of co-pending application Ser. No. 07/810,562, filed on Dec. 20, 1991, abandoned, which is a continuation of co-pending application Ser. No. 07/421,257, filed on Oct. 13, 1989, abandoned.

BACKGROUND AND OBJECTS OF THE INVENTION

1. Field of the Invention

The present invention relates generally to handling devices for automatically produced packages or other production units, and more particularly, to certain new and useful improvements in a collating system which is particularly useful in transferring such packages or production units away from the production machinery and into shipping containers.

2. Description of the Prior Art

Modern production and packaging technology have created the ability to produce large volumes of a broad range of packages, particularly relatively small units, such as plastic individual coffee creamers, single service units of jams, jellies, and the like; boxes of tacks, small nuts, bolts, screws, and the like; individual service cups of butter or margarine, etc. Examples of such single use dispensing packages are described in U.S. Pat. Nos. 3,986,640, 4,493,574, 4,611,715, 4,720,014, 4,724,982 and can be produced by machines such as those described in U.S. Pat. Nos. 4,700,532 and 4,819,406.

Many previously known package structures or other production units can be simply dumped at random into a shipping container and shipped with little or no difficulty, for example where the soft "pillow" pouches of the dispenser packages described in U.S. Pat. No. 4,493,874 contain products like ketchup, mustard, soy sauce, mayonnaise, various medicinal solutions or gels, such as alcohol, iodine, surgical jelly, etc.

In many instances, however, packages or other production units are assembled from both flexible and stiff materials, plastics, foils, paperboard, etc. These articles generally cannot be randomly dumped into a shipping container, but must be collated (organized) and discretely packed into containers for shipping, retail sale or dispensing so that they can be shipped without being damaged in transit. Also, in the case of dispenser packages, it is often necessary that they be handled and shipped carefully to ensure that they will have proper end use qualities and can be easily dispensed when desired. With modern equipment capable of producing such dispenser packages or other units at rates of hundreds or even thousands per minute, carrying out such collating and packing by hand is excessively expensive, and thus, commercially detrimental.

As a result, a variety of packing and collation systems have been previously developed. Many of such prior systems utilize suction cups which simultaneously pick up a number of articles by suction, remove them from the production machine and transfer a set of one or more of them by mechanical means to another location where a box or paperboard tray is waiting to receive the transferred sets. The cycle ends when the suction cup assembly releases the article sets and mechanically travels back to the producing machine to pick up another set of articles and repeat its action. As the suction cup assembly moves back to the machine, the filled tray or box is removed and replaced by an empty one to await loading. As will be realized, such a system has many limitations and drawbacks. For example, if it is to pick up forty articles at each cycle, it must have forty operating suction cups (or stations of one or more cups). These suction cups are relatively fragile, and must be attached to a vacuum system by piping or tubing, necessitating a complex air valving system. Should anything in the air-vacuum system clog, even at a single cup, then the entire system, both production and collation, must be stopped while repairs are made. This obviously leads to expensive "down time" during which no packages are produced and the operator labor is idle. Similarly, if any of the vacuum tubes breaks or becomes punctured or develops a leak, the system also becomes inoperable, again resulting in costly repair "down time".

Moreover, previously known collating systems are generally limited in that they can only collate in a single pattern. There are previously known collating systems which are adjustable, but these are very expensive, costing on the order of hundreds of thousands of dollars, some even higher. Furthermore, altering these prior systems to accommodate different patterns again requires expensive "down time" as well, since the machine must be stopped to make the pattern changeover. In addition, the trays into which such devices place the individual or sets of production units are not inexpensive, each costing on the order of two to ten cents, or possibly more, depending upon their size and the material from which they are fabricated. Then there is the additional expense of general maintenance; these prior collators must be regularly checked, repaired, lubricated and cleaned.

There are other previously known systems for collating various articles produced by automatic machinery ("production units") which are too numerous to list, all of which involve mechanical means such as pushers, mechanical claws, forks, pincers, spatulas, centrifugal discs, and gating. All of these previously known collating systems suffer similar drawbacks in that they are generally expensive, have only limited patterns of collation and require costly regular maintenance.

Having seen many of the aforesaid collators, and in fact having been granted U.S. Pat. No. 3,631,652 on a mechanized collator myself, I have now devised a system which is totally different from any I have ever seen or observed, which system is of unique simplicity, requires minimal maintenance and permits a significant variety of collating patterns.

OBJECTS OF THE INVENTION

It is therefore an object of this invention to provide a new and improved collating system particularly useful in handling small production units, such as single-service portion dispenser packages, at significantly lower cost than previously known collating systems.

Another object of this invention is to provide a new and improved collator that collects and locates individual production units in a manner suitable for shipment which will protect the integrity of the unit during handling or shipping.

Yet another object of this invention is to provide a new and improved collator that gathers and secures production units in an arrangement suitable for shipment using low-cost materials.

A further object of this invention is to provide a new and improved collator which is reliable, requires minimal maintenance and is easily adaptable to continuous or intermittent package or unit production.

Another object of this invention is to provide a new and improved collator system that eliminates the need for boxing or other individual packaging of the individual production units.

Another object of this invention is to provide a new and improved collator system that uses a thin web of material, on the order of 0.003" thick, for locating and removably holding the production units while they are transferred from the production machinery to the shipping containers and thereafter during shipment, instead of the now customary chipboards or five-sided "trays" having a thickness at least on the order of ten times greater, thereby significantly reducing the amount of disposable packaging garbage or waste of presently used collating systems and, of course, thereby also reducing costs.

Objects and advantages of the invention are set forth in part herein and in part will be obvious herefrom, or may be learned by practice with the invention, the same being realized and attained by means of the instrumentalities and combinations pointed out in the appended claims.

The present invention consists in the novel parts, constructions, arrangements, combinations, steps and improvements herein shown and described.

SUMMARY OF THE INVENTION

I have observed that single-service portion packaging machines and other machines that automatically produce large quantities of production units invariably produce these units or packages in a uniform and consistent organization. These packages or production units typically emerge in a straight line, one following another, or in sets, consecutively.

Briefly described, and as here preferably embodied, my collator invention comprises a mechanism which feeds an adhesive coated continuous sheet of paper or web stock (hereafter sometimes referred to as "ACP") to the location where the finished units or packages are leaving a packaging or other production machine. The adhesive preferably is of the peelable type, and one which is not too tacky, so that the packages or production units can be readily peeled or removed from the base sheet covered by the adhesive when desired.

The packages or production units preferably are pressed onto the ACP, to thereby become removably attached to the adhesive coating, by a resilient pressing means.

Advantageously, and as here preferably embodied, the adhesive coated paper is drawn from a roll by draw rollers with suitable non-stick surfaces. Between the roll of ACP and said draw rollers, the ACP web runs over a dancer arm which activates a suitable brake system for braking of the roll of ACP. After being pulled through the draw rollers, the ACP web is directed onto a relatively thin but rigid base plate with its adhesive coated surface facing upwardly (away from the plate). The plate advantageously may have a treated surface, such as "Tufram", which is a hard, low friction commercial treatment for aluminum. This thin base plate is positioned so that it is adjacent the line of ejection of the units produced by the producing machine, to thereby guide the ACP directly beneath the production units leaving the production machine. Finally, as preferably embodied, first resilient pressing means is provided to gently press, and thereby locate the individual production units onto the ACP. A short distance away from the first compressing station is a resilient overhead drive assembly which simultaneously further compresses the production units onto the ACP and slidably draws the ACP in timed relationship with both the ACP draw rollers and the speed of movement of the production machine.

As can be readily seen from the foregoing, the ACP is covered by a continuous pattern of the units being produced, which are peelably, i.e., removably adhered to it. It will also be appreciated that if the producing or packaging machine delivers the production units continuously, then a spongelike or other resilient roller may advantageously perform the compressing and adhering of the units to the ACP and the ACP will move forward at whatever rate is desired to accommodate the units being delivered to it by the production machine.

Once the packages or other production units are attached to the ACP, many configuration options are possible. For example, the ACP can be slit longitudinally as it advances simply by placing a fixed slitting blade in the desired location. Alternatively, more than one slitting blade can be mounted, making several longitudinal slits, forming multiple strips of production units attached to the ACP.

Transverse cutting of the ACP is necessary to separate groups of adhered collated packages or other production units. Transverse cutting of the ACP in an intermittent machine advantageously may be performed by a "flying blade", which moves at right angles to the direction in which the ACP with attached production units moves. Where the production machine has intermittent motion, the flying blade preferably cuts the ACP transversely at a moment when the machine is not advancing. In a continuous motion production machine, the flying blade preferably travels at an angle so as to compensate for the forward movement of the ACP while it is being cut.

It will be understood from the foregoing that groups of packages may be removed in sheets or strips, in a great variety of combinations, some of which are shown in the accompanying drawings.

A further advantage of the ACP collating system in accordance with my invention, beyond its simplicity, low equipment cost, and the low cost and environmental disposal advantages of the ACP material itself, is that the packages or other production units are restrained from slipping or sliding in their shipping container, which also serves to protect them from damage during transit.

The sheet or web of ACP to which the production units have been adhered also protects the corners and surfaces of the units, particularly where packages are being collated, from being damaged during handling both prior to, during and after shipment.

The sheet or web of ACP also advantageously may be readily and inexpensively printed with promotional or instructive information, which is not the case when cardboard trays are used.

In an alternative embodiment of my collator invention, it has been found that where the units to be collated do not have a flat bottom surface, this system can still be used if the ACP is provided with a recessed pocket, as by puncturing with suitable punch means, such as a punch which cuts an "X" or "Y" crossed-slit pattern in the ACP so that the curved bottom of the production unit sits in a cup-like recess or concavity created by the puncture or other weakening device.

In a still further alternate embodiment of my invention, holes advantageously may be punched or otherwise provided in the ACP or, as yet another alternative, in a non-adhesive coated plain paper or web, in a size and configuration adapted to receive a major portion of the production unit. While the latter alternate embodiment does not offer all the benefits of ACP, it may be adequate for some needs.

The accompanying drawings, referred to herein and constituting a part hereof, illustrate preferred embodiments of the invention, and together with the description, serve to explain the principles of the invention.

DETAILED DESCRIPTION OF THE INVENTION

Referring now more particularly to FIGS. 1–5 of the accompanying drawings, there is illustrated a preferred embodiment of a collator system constructed in accordance with the present invention. As here preferably embodied, the collator system of my invention is advantageously adapted for the handling and organizing of single-service portion dispenser packages. Such a system advantageously can be used as an adjunct to machines like the form-fill-seal machine described in my aforesaid U.S. Pat. No. 4,819,406, the disclosure of which is hereby incorporated by reference.

While the collating apparatus of my invention as embodied herein is particularly adapted to and was designed for use in conjunction with the operation of my aforesaid form-fill-seal machine (U.S. Pat. No. 4,819,406), it will be understood that the principles of operation are not limited to such usage. However, since the invention is especially suitable for such usage, reference will be made hereinafter thereto in order to provide an example of a practical and useful embodiment of the invention.

Figure 1:
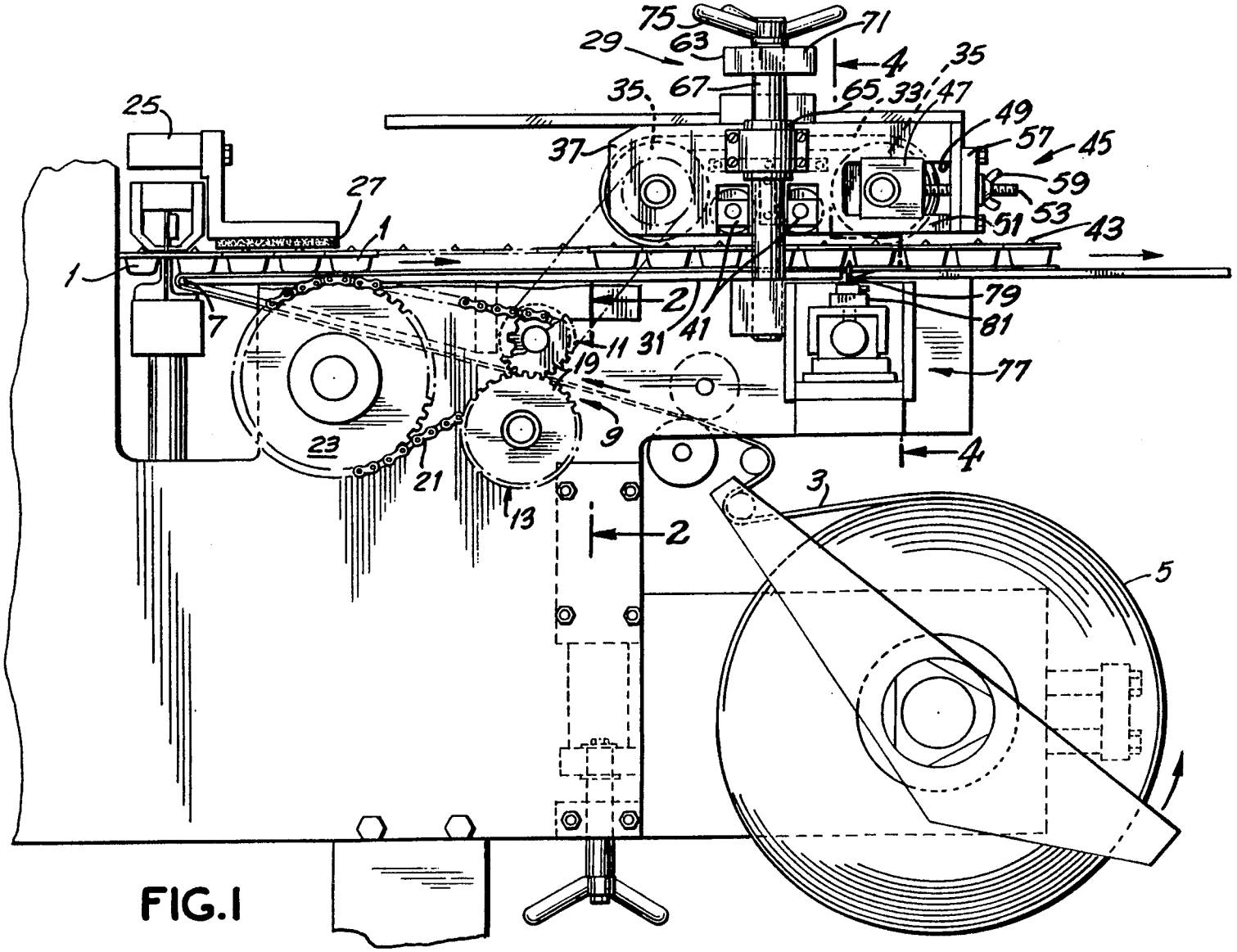
FIG. 1 is a view in side elevation of a package collator system constructed in accordance with the present invention.
Figure 1A:
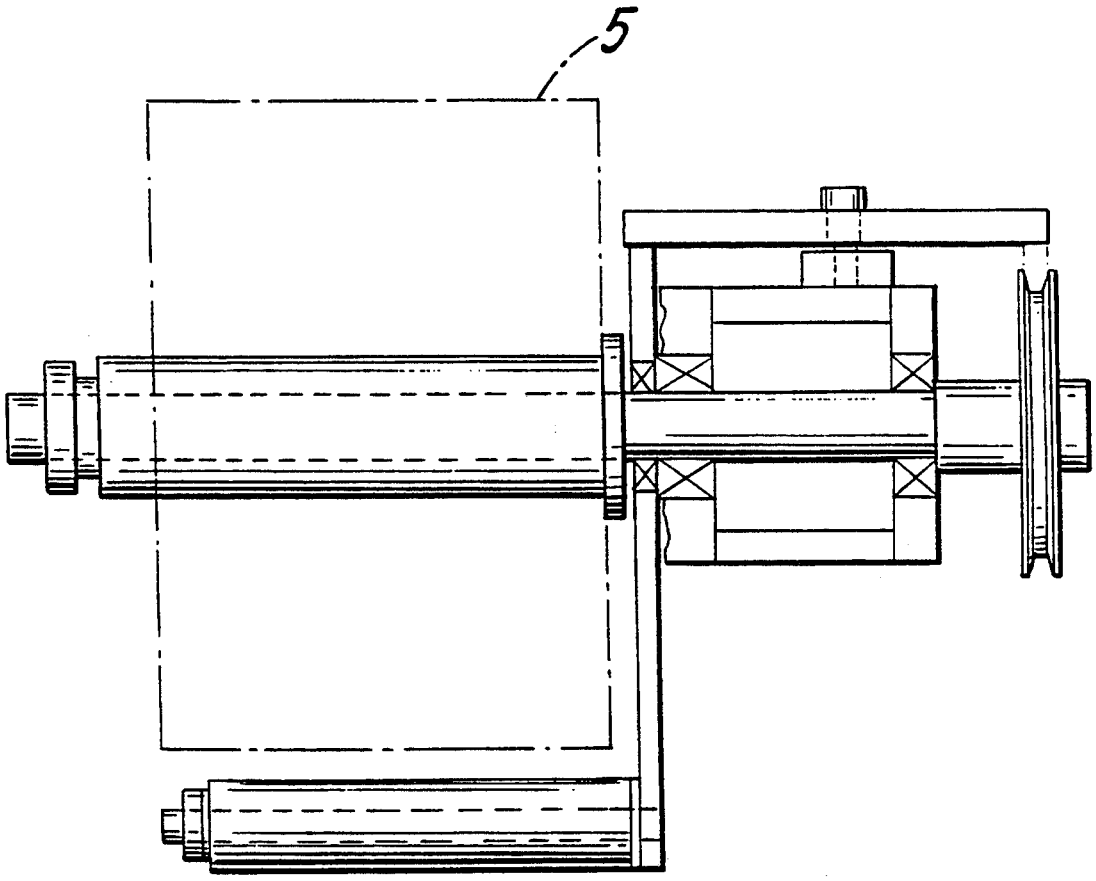
FIG. 1A is partial view in end elevation illustrating the braking mechanism activated by the dancer arm.

Turning now to FIG. 1, a package collator is depicted in accordance with the present invention. Dispenser packages 1 enter the package collator from the dispenser package filling device on the left and generally move to the right. These packages 1 are closely spaced in a regular pattern. They can be kept in this pattern by means well-known in the art, as, for example, side rails, or grooves in the base plate over which they slide. As packages 1 move to the right they pass above an adhesive web 3 which advantageously comprises an adhesive contact paper ("ACP"). The ACP 3 is carried on a supply roll 5 and as the ACP feeds out it is oriented so as to pass immediately beneath the moving dispenser packages 1. The ACP material is coated with a suitable adhesive on one side and a suitable release coating on the opposite side.

As shown in FIG. 1, as here embodied, the adhesive side of the ACP 3 faces inwardly on the roll 5. As here embodied, therefore, as the ACP 3 feeds out from the roll 5 the adhesive side faces downwardly until it approaches the dispenser packages 1, whereupon ACP 3 is re-oriented so that the adhesive now faces upwardly. The ACP orientation can be suitably changed by having the ACP 3 pass over a roller (not shown) or the smoothly rounded end of the support plate, such as shown at 7. The ACP 3 moves to the right beneath the dispenser packages 1, which move in the same direction. Alternatively, it will be understood that ACP 3 equally satisfactorily may be oriented on its supply roll with the adhesive coated side facing outwardly and the supply roll mounted so as to permit the sheet to be pulled directly over the rounded end of support plate 7.

Figure 2:
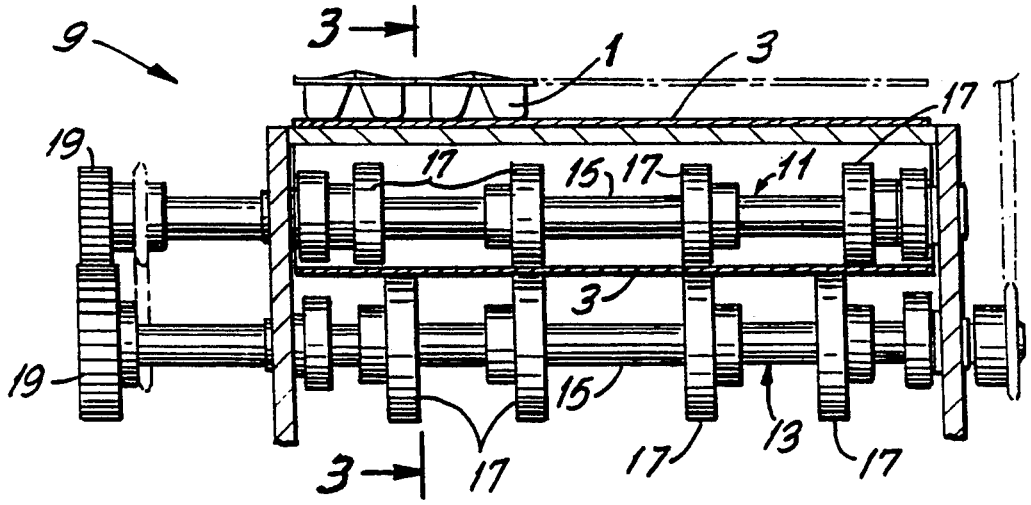
FIG. 2 is a front elevation view, partly in section, of the package collator of FIG. 1 as seen in the direction of arrows 2—2 in FIG. 1, the view illustrating in greater detail the roll mechanisms which draw the ACP from its supply roll.
Figure 3:
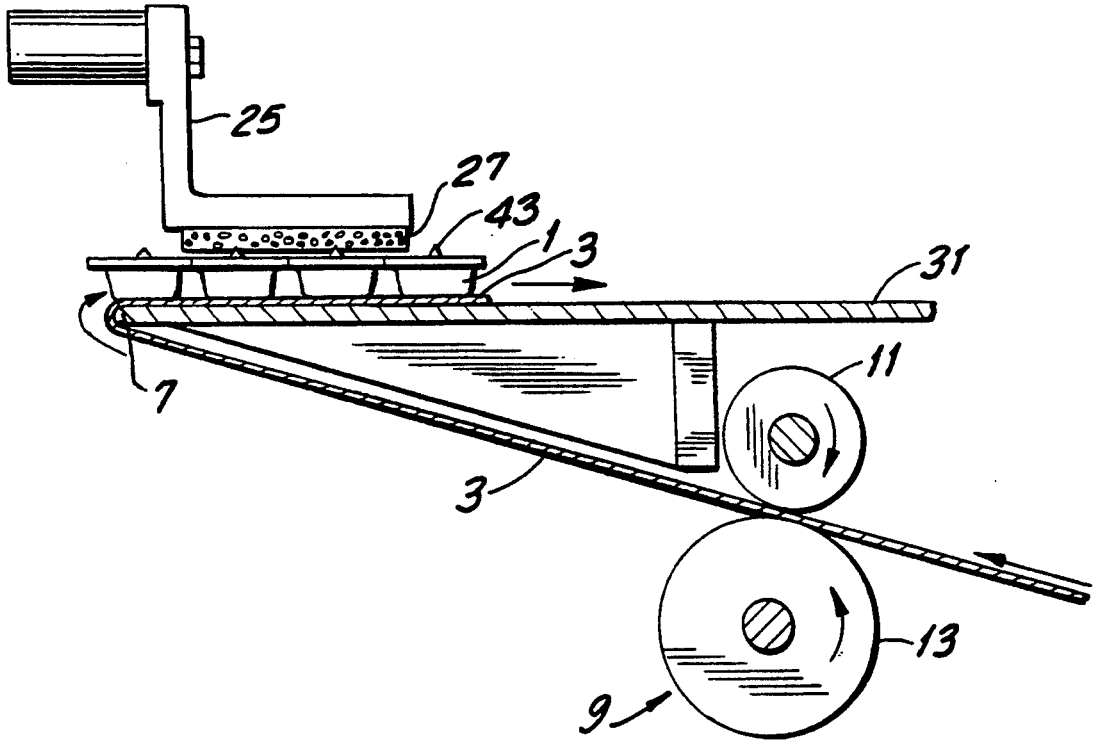
FIG. 3 is a view in side elevation, partly in section, taken along line 3—3 in FIG. 2, illustrating in greater detail the ACP draw rollers, the base plate along which the ACP travels for receiving the production units, and the manner in which typical production packages are attached to the ACP web.

As best seen in FIGS. 2–3, a draw roller system 9 serves to pull the ACP sheet 3 from the roll 5 at a suitable speed. ACP 3 is drawn with or without pauses, depending upon whether the dispenser packages 1 are filled and separated intermittently or continuously. Mechanisms for achieving the desired motion are in and of themselves well known. As here preferably embodied, draw roller system 9 includes upper and lower draw rollers 11, 13, each mounted to a central shaft 15 on which a number of contact rollers 17 are also mounted. Preferably, the two shafts 15 have contact rollers 17 arranged along their lengths in a pattern such that some of the top and bottom contact rollers oppose one another, with the ACP 3 passing between them, while other contact rollers are staggered so that, although they touch the ACP, there is no opposing contact roller 17 on the other side. As depicted in FIG. 2, the top and bottom shafts 15 are connected to one another by spur gears 19. Gears 19 are suitably dimensioned so that the peripheral velocities of the upper contact rollers 17 are the same as that of the lower contact rollers 17. As depicted in FIG. 1, power is transferred to these shafts by a power take-off chain 21 which is driven by a sprocket 23.

As here preferably embodied, as the dispenser packages 1 continue moving to the right they pass beneath a resilient pressure member 25 lying just slightly above them. Advantageously, a spongy rubber or other suitable resilient material 27 actually presses on the top part of the packages 1. This urges the packages 1 downwardly. This downward pressure is suffient to cause the packages 1 to become adhered to the adhesive side of ACP 3 which, as noted previously, has been oriented so as to face upwardly. Once packages 1 are adhered to ACP 3, they cannot move about with respect to one another.

In accordance with the invention, means are provided for maintaining the rightward motion of the dispenser packages 1 and the ACP to 3 which they are attached. To that end, as FIG. 1 also depicts, an upper draw mechanism 29 is suitably arranged for this purpose. Because the dispenser packages 1 are affixed to ACP 3, the packages and ACP move together. Thus, it is now necessary to urge only the packages 1 or the ACP 3 to the right.

Figure 4:
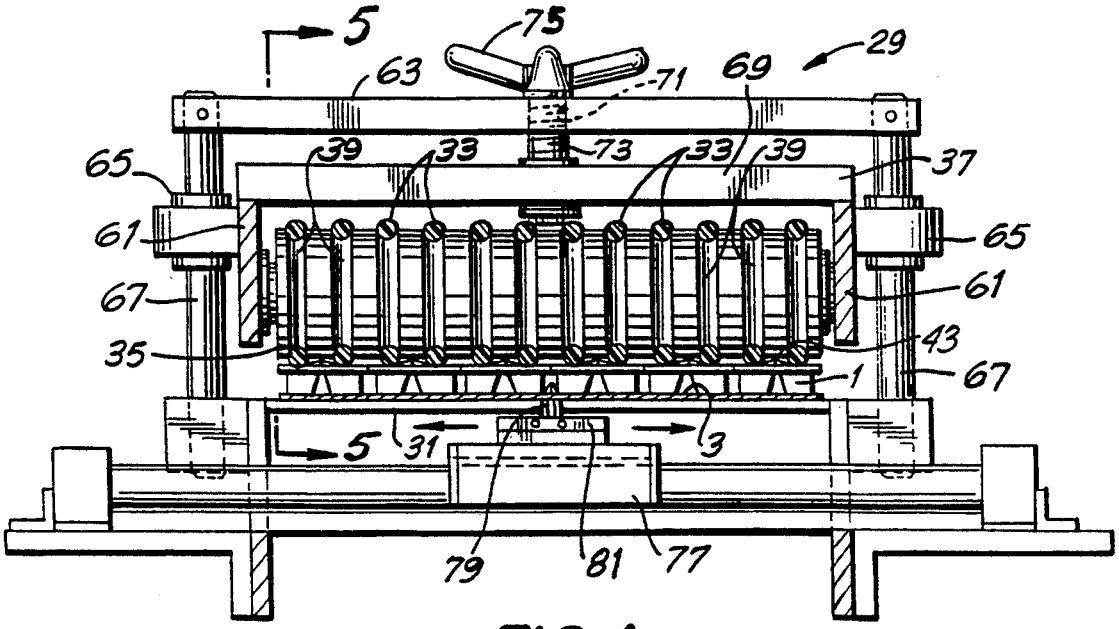
FIG. 4 is a front elevational view taken along lines 4—4 of FIG. 1, illustrating the belt mechanism and double-edged flying blade of the present invention, which draw and separate groups of production packages attached to the ACP.
Figure 5:
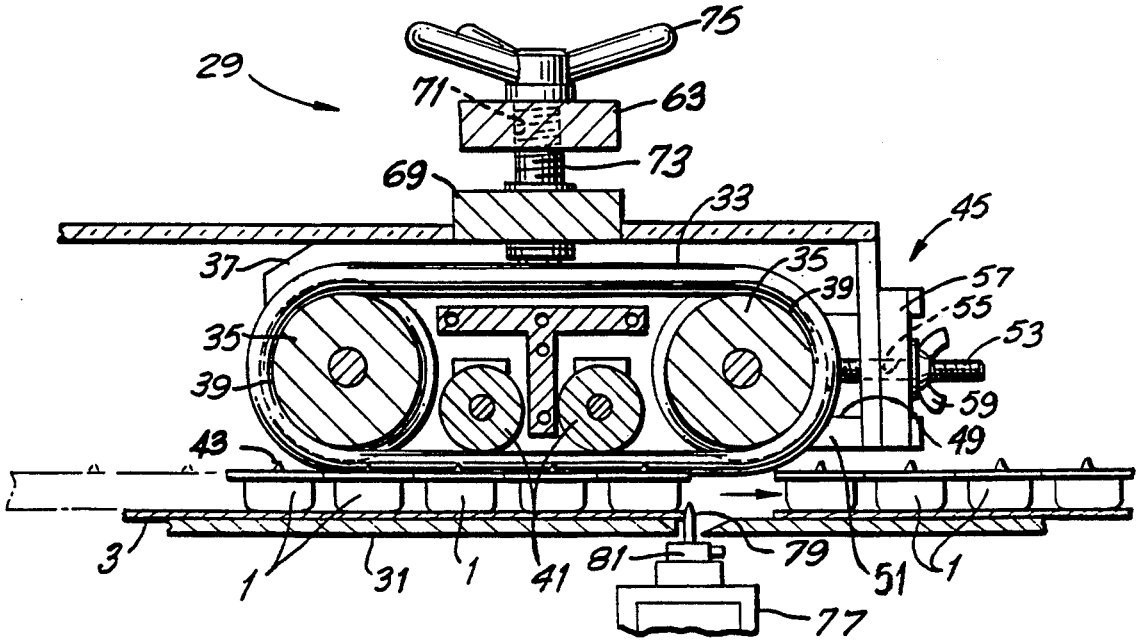
FIG. 5 is a view in side elevation, partly sectional, taken along lines 5—5 of FIG. 4.
Figure 6:
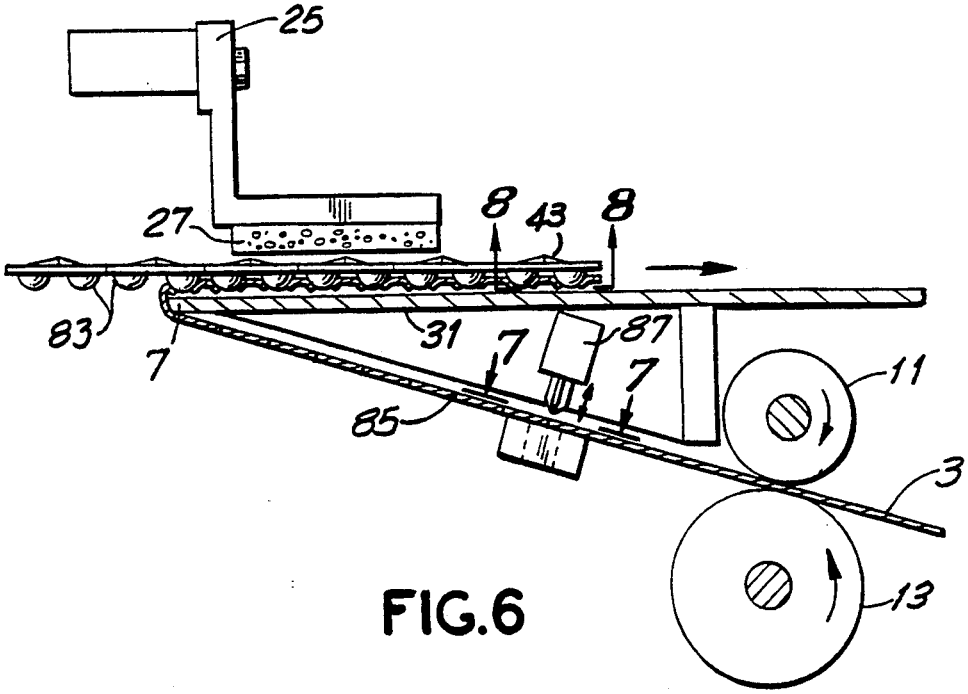
FIG. 6 is a view similar to that of FIG. 2, illustrating an alternative embodiment of the present invention, whereby packages units having rounded bottoms are collated by an ACP provided with pockets created by a punch member.
Figure 7:
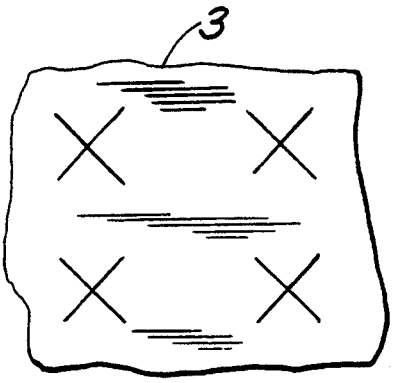
FIG. 7 is a fragmentary plan view of the ACP provided with crossed-slit weakened areas formed by the punch of FIG. 6 to facilitate the use of the invention with containers having rounded bottoms.
Figure 8:
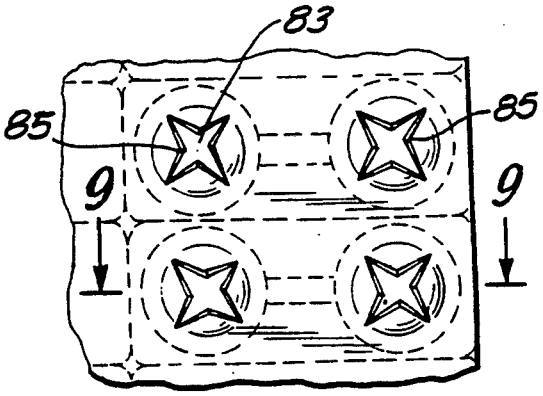
FIG. 8 is a fragmentary bottom plan view of the ACP shown in FIG. 7 after packages having rounded bottoms have been attached to it.
Figure 9:
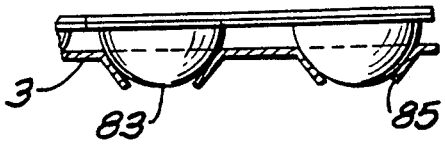
FIG. 9 is an enlarged side elevational view, partly in section, taken along lines 9—9 of FIG. 8, showing in greater detail the locating and holding of packages by an ACP web with punctured pocket-like recess.

Referring to FIGS. 4–5, it will be seen that the upper draw mechanism 29 lies atop the dispenser packages 1, which themselves lie atop and are adhered to the ACP 3. The ACP 3 is supported by a relatively smooth and rigid base plate 31. It is important that this base plate 31 be smooth so that the ACP 3 will not bind and jump as it moves to the right. This base plate 31 also supports the dispenser packages 1 and underlies ACP 3 so that they resist an applied vertical pressure, ensuring adherence of packages 1 to the adhesive of ACP 3.

As here preferably embodied, upper draw mechanism 29 contains a number of endless bands 33 which are circular in cross-section. These bands 33 pass around two horizontal parallel primary rollers 35, which rollers are mounted in a frame 37. The rollers 35 are themselves grooved at 39, and the bands 33 ride in grooves 39. Grooves 39 should not be so deep that the entire band 33 rides in the groove, but rather, sized so that a portion of the band protrudes above the roller surface. Advantageously, a number of idler rollers 41 may be provided between the two primary rollers 35 and serve to press band 33 downwardly. These idler rollers 41 preferably are, but need not be, grooved to accept the bands 33.

As will be seen in FIG. 4, dispenser packages 1 are constructed so as to have small protrusions 43 in their top surface. When the collating system of the present invention is used to handle such dispenser packages 1, the bands 33 and grooves 39 of the upper draw mechanism 29 preferably are positioned to contact the tops of the dispenser packages alongside, rather than atop, these protrusions 43.

Those ordinarily skilled in the art will appreciate that when the bands 33 are under the proper amount of tension, rotation of one primary roller 35 will cause the bands to rotate themselves, thereby driving both the other primary roller and the idler rollers 41. Ordinarily, only one of the primary rollers 35 will be driven. As shown in FIG. 1, power advantageously may be transmitted to one primary roller 35 from the same sprocket 23 used to drive the ACP draw rollers 11, 13 The power transmission system is preferably designed so that the belts 33 have a velocity which is the same as the velocity of the ACP 3 being driven by draw rollers 11, 13 before the dispenser packages 1 are joined to the ACP. It is necessary to match these velocities so as to avoid placing undue tension on the ACP 3. The entire upper draw mechanism 29 is positioned at a height above the dispenser packages 1 whereby the bottommost surface of the bands 33 lies slightly below the tops of the dispenser packages. In this way, as the dispenser packages 1 and ACP 3 pass beneath the upper draw mechanism 29, the bands 33 press slightly downwardly on the packages, pressing them against the base plate 31. This results in a horizontal friction force between the dispenser packages 1 and ACP 3, simultaneously urging both to the right. The aforesaid friction force is transmitted through the dispenser packages 1 to the entire ACP 3, thereby maintaining tension on the ACP after it has passed through the ACP draw rollers 11, 13.

The upper draw mechanism 29 contains several adjustment mechanisms, best seen in FIGS. 4–5, which facilitate the operation of the collating system of my invention as here embodied. These mechanisms enable users to adjust the spacing of the two primary rollers 35 and change the height of the entire draw mechanism 29 above the dispenser packages 1 and ACP 3.

The mechanism 45 which varies the spacing between the primary rollers 35 is relatively simple; the ends of the primary roller shaft which is not driven are mounted in slide blocks 47, which are free to move horizontally along channels 49 in the frame 37. The slide blocks 47 each of which contains a threaded rod 53 fixedly connected to it, slide in yokes 51 machined into the end of frame brackets 61. The fixedly mounted threaded rods 53 pass through clearance holes 55 in plates 57 mounted on the end of yokes 51, each of which engages a threaded wing nut or handle 59. When the wing nuts or handles 59 are turned, the threaded rods 53 are drawn horizontally through the clearance holes 55, in turn drawing the slide blocks 47 along yokes 51. Mechanism such as just described are frequently used in band-driven equipment so that operators can easily replace the bands after they become stretched or worn.

The other adjustment mechanism allows users to move the entire upper draw mechanism 29 vertically. This increases machine flexibility in two ways. First, should the height of the dispenser packages 1 or the thickness of the ACP 3 change, users can reposition the upper draw mechanism 29 so as to maintain proper contact with the dispenser packages. Second, by moving the upper draw mechanism 29, the tension on the ACP 3, which is a direct function of the downward force on the packages 1, can be varied. This mechanism is also relatively simple. The primary and idler rollers 35, 41 are all mounted in the frame 37, which includes two horizontal, parallel brackets 61. Brackets 61 rigidly are joined to one or more spacer brackets 63 extending across the width of the ACP 3. Each parallel bracket 61 bears a bushing 65. Smooth vertical rods 67 extend upwardly through bushings 65, and the tops of the rods are joined to a horizontal plate 69 having a threaded bore 71 in its center. Plate 69 serves two functions. First, it holds the rods 67 in proper orientation. Second, it helps in controlling the vertical position of the upper draw mechanism 29. A threaded rod 73 passes through bore 71 and engages its threads. The rod 73 is rotatably attached to the spacer bracket 63. A wing nut or handle 75 is joined to the top of the threaded rod 73. By turning the wing nut or handle 75, the threaded rod 73 can be moved upwardly or downwardly, thereby altering the height of the upper draw assembly 29.

Once the dispenser packages are removably adhered to the ACP 3, in accordance with the invention, means are provided for cutting the ACP to manageable sizes. To this end, as here preferably embodied, slitting knives may be provided in the ACP's path, which knives cut in a direction parallel to the movement of the ACP 3. If such knives are used, the ACP 3 can be cut into varyingly-sized narrower strips, which strips can then be wound to form rolls of dispenser packages removably mounted to an adhesive strip. A horizontal flying knife 77 can also be used to periodically cut across the width of the ACP 3. Such a flying knife 77 is shown in FIGS. 1, 4 and 5, and is a device well-known in the art. It consists of a blade 79 mounted in a holder 81, which holder is free to move horizontally. If the ACP 3 is to be cut while it is stationary, the knife 77 preferably may move at right angles to the ACP's direction of movement. Should it be desirable to cut the ACP 3 while it is moving, the knife 77 preferably moves across the ACP at an angle, thereby producing a straight cut across the moving ACP. It will be understood that, by allowing several rows of dispenser packages 1 to pass beyond the knife 77 and then activating the knife, discrete individual sheets of predetermined size can be produced having a rectangular array of dispenser packages peelably attached to a flat sheet of paper or other preferably thin material. This is an especially desirable storage configuration, because the flat sheets can be stacked in a shipping box or other container, one on top of another, while maintaining the individual packages in a predetermined fixed pattern.

FIGS. 6–9 show yet other alternate embodiments of the collator system of my present invention, which are particularly suitable for use when the dispenser packages, or other production units, have rounded bottoms such as shown at 83. Dispenser packages having such rounded bottoms 83 may have difficulty adhering to a flat ACP 3, even though adhesive is used. To that end, in this embodiment a pocket 85, such as a concavity or cup-like depression, is advantageously provided in ACP 3 beneath each rounded bottom 83 of dispenser packages 1. It will be seen that, by creating concavities or cupped pockets 85 in ACP 3 increased adhesive surface area contacts rounded surfaces 83, thereby securely holding packages 1 on ACP 3. As here preferably embodied, pocket 85 is produced by a reciprocating punch 87, advantageously in the shape of an "X" or "Y" which punch is located downstream of the ACP draw rollers 11, 13, but before the point where the ACP 3 and dispenser packages 1 meet. Punch 87 moves up and down at a frequency calculated to produce a series of crossed-slit openings having a spacing that is the same as that separating the dispenser packages 1. The number of punches 87 is equal to the number of desired rows of dispenser packages 1, the punches being spread across the width of the ACP 3 in the desired spacing sequence.

In a still further alternate embodiment of my invention, it will be understood that a complete hole may be suitably punched or otherwise formed in a web of thin ACP 3 or, as still another alternative, a thin web of non-adhesive coated plain paper or other suitable sheet material, the size and configuration of each such hole adapted to receive a major portion of the package or production unit. For example, in the case of package 1 having rounded bottoms 83, each hole advantageously may receive an entire bottom lobe 83, enabling the underside of the flat portion of package 1 to rest directly on the collating web material, thereby locating package 1 on the web. Where the web is ACP 3, it will be seen that, in such embodiment, the underside of the top margins of the package is removably adhered to the collator web while the rounded lobes 83 extend beneath the web, in a manner similar to that shown in FIG. 9.

It will be understood that the adhesive applied to the collating web member in accordance with my invention advantageously may be selected from generally available adhesive formulations so that it will adhere to the web member and yet removably adheres itself to the article being collated in such a manner that, upon completion of shipping or handling, the collated article may be peelably removed from the adhesive, again advantageously without flecking or other defacement of the surface of the collated article. It will be understood that, since a variety of such available adhesive formulations may be employed and a variety of materials will be used in the collated articles, selection of a particular adhesive formulation for a particular surface on the article being collated will be a matter of choice within the ability of those persons of ordinary skill in the packaging art.

The invention in its broader aspects is not limited to the specific embodiments herein shown and described, but departures may be made therefrom within the scope of the accompanying claims, without departing from the principles of the invention and without sacrificing its chief advantages.

What is claimed is:

1. A method for collating a plurality of articles supplied in a regular, repeating orientation, including the steps of:

positioning a movable collating web of thin sheet material adjacent and directly beneath said supply of said articles;

moving said collating web in a direction laterally away from said supply of said articles;

passing said articles and said web beneath a first pressure location and applying pressure onto said articles at said first pressure location to place said articles in a discrete, spaced relationship to one another onto said movable collating web;

removably holding said articles in said discrete, spaced relationship during movement of said collating web to thereby transport said articles from said supply in a collated arrangement;

passing said articles and said web beneath a second pressure location downstream of said article supply and applying pressure onto said articles and said web at said second pressure location to urge said articles and said web away from said article supply; and further including the step of;

forming locating positions in said collating web adapted to receive and removably hold said articles in said discrete, spaced relationship.

2. A method for collating a plurality of articles supplied in a regular, repeating orientation, including the steps of:

positioning a movable collating web of thin sheet material adjacent and directly beneath said supply of said articles;

moving said collating web in a direction laterally away from said supply of said articles;

passing said articles and said web beneath a first pressure location and applying pressure onto said articles at said first pressure location to place said articles in a discrete, spaced relationship to one another onto said movable collating web;

removable holding said articles in said discrete, spaced relationship during movement of said collating web to thereby transport said articles from said supply in a collated arrangement; and passing said articles and said web beneath a second pressure location downstream of said article supply and applying pressure onto said articles and said web at said second pressure location to urge said articles and said web away from said article supply; and further including the step of:

forming locating positions in said collating web adapted to receive and removably hold said articles in said discrete, spaced relationship; wherein said locating positions are formed in said web by weakening predetermined portions of said web to create at least one recess adapted to receive at least a portion of one of said articles.

3. A method for collating a plurality of articles supplied in a regular, repeating orientation, including the steps of:

positioning a movable collating web of thin sheet material adjacent and directly beneath said supply of said articles;

moving said collating web in a direction laterally away from said supply of said articles;

passing said articles and said web beneath a first pressure location and applying pressure onto said articles at said first pressure location to place said articles in a discrete, spaced relationship to one another onto said movable collating web;

removably holding said articles in said discrete, spaced relationship during movement of said collating web to thereby transport said articles from said supply in a collated arrangement;

passing said articles and said web beneath a second pressure location downstream of said article supply and applying pressure onto said articles and said web at said second pressure location to urge said articles and said web away from said article supply;

forming locating positions in said collating web adapted to receive and removably hold said articles in said discrete, spaced relationship wherein said locating positions are formed by openings in said collating web, each of said openings adapted to receive a portion of each of said articles to be collated.

4. A collator system for receiving and transporting a plurality of articles supplied in a regular, repeating orientation, including:

means positioning a collating web member adjacent and directly beneath said supply of said article;

a first pressure member adjacent said article supply for applying pressure onto said articles to place said articles onto said movable collating web in a discrete, spaced relationship to one another;

means moving said collating web member in a direction laterally away from said article supply, including a second pressure member downstream of said article supply for applying pressure onto said articles and said web to urge said articles and said web as a unit in the direction of said web;

means removably holding said articles in said discrete spaced relationship during movement of said collator web to thereby transport said articles from said supply in a collated arrangement, said system including means forming locating positions on said collating web for receiving and removably holding said articles in said discrete, spaced relationship to one another.

5. A collator system as claimed in claim 4, wherein said means forming locating positions on said collating web comprises punch means for puncturing said web at each of said locating positions;

said punch means forming pocket portions in said web adapted to locate said articles.

6. A collator system as claimed in claim 5, wherein said means forming said locating positions on said collating web comprises at least one opening adapted to receive a portion of at least one of said articles.

7. A collator system for receiving and transporting a plurality of articles supplied in a regular, repeating orientation, including:

means positioning a collating web member adjacent and directly beneath said supply of said articles;

a first pressure member adjacent said article supply for applying pressure onto said articles to place said articles onto said movable collating web in a discrete, spaced relationship to one another;

means moving said collating web member in a direction laterally away from said article supply, including a second pressure member downstream of said article supply for applying pressure onto said articles and said web to urge said articles and said web as a unit in the direction of said web;

means removably holding said articles in said discrete, spaced relationship during movement of said collator web to thereby transport said articles from said supply in a collated arrangement;

roll means carrying a supply of thin sheet material;

means drawing said sheet material from said supply roll to form said collating web member; and wherein said means moving said collating web member in a direction laterally away from supply of said articles includes a web support plate and said second pressure member includes final resilient pressure draw means including one or more primary engagement rollers adapted to press said articles onto said collating web and said collating web onto said support plate to thereby move said articles and collating web as a unit in the direction of movement of said web material supply roll draw means;

wherein said final draw means comprises:

a frame;

two primary rollers each having an axis, said axes being parallel to one another and lying in a horizontal plane generally perpendicular to the direction of movement of said web, said primary rollers being rotatably mounted in said frame;

at least one flexible band member, said band member passing around said primary rollers, said primary rollers being spaced apart a predetermined variable distance to place said band under tension; and means for driving at least one of said primary rollers;

wherein said driven primary roller of said final draw means is connected to and driven by said means for drawing said sheet material from said supply roll to form said collating web member.

* * * * *

UNITED STATES PATENT AND TRADEMARK OFFICE

CERTIFICATE OF CORRECTION

PATENT NO. : 5,364,484

DATED : November 15, 1994

INVENTOR(S) : SANFORD REDMOND

It is certified that errors appear in the above-identified patent and that said Letters Patent is hereby corrected as shown below:

In Column 10, Claim 1, line 46, delete ";" and insert therefor -- : --.

In Column 10, Claim 2, line 63, delete "removable" and insert therefor -- removably --.

In Column 11, Claim 4, lines 59-60, insert a comma (,) between the words "discrete" and "spaced".

Signed and Sealed this

Sixth Day of June, 1995

Bruce Lehman

*Attest:*

BRUCE LEHMAN

*Attesting Officer*

*Commissioner of Patents and Trademarks*